US005120188A

United States Patent [19]

Harrison

[11] Patent Number: 5,120,188

[45] Date of Patent: Jun. 9, 1992

[54] FORK STABILIZING DEVICE

[75] Inventor: William J. Harrison, Guelph, Canada

[73] Assignee: Kenhar Products Inc., Guelph, Canada

[21] Appl. No.: 619,640

[22] Filed: Nov. 29, 1990

[51] Int. Cl.[5] ..... B66F 9/75

[52] U.S. Cl. ..... 414/785

[58] Field of Search ..... 414/785, 607, 685, 705, 414/722, 723, 724

[56] References Cited

U.S. PATENT DOCUMENTS

| | | | |
|---|---|---|---|
| 2,368,122 | 1/1945 | Dunham | 414/607 |
| 2,456,320 | 12/1948 | Repke | 414/785 X |
| 2,596,747 | 5/1952 | Ward et al. | 414/785 |
| 2,668,602 | 2/1954 | Cushman | 414/785 X |
| 2,675,139 | 4/1954 | Mercier et al. | 414/785 X |
| 2,686,324 | 8/1954 | Costarella | 414/607 X |
| 3,071,268 | 1/1963 | Wales | 414/607 |
| 3,122,252 | 2/1964 | Jones | 414/785 |
| 3,709,394 | 1/1973 | Strandberg et al. | 414/785 |
| 4,050,599 | 9/1977 | Bender | 414/785 X |
| 4,279,567 | 7/1981 | Thompson | 414/785 |
| 4,488,832 | 12/1984 | Kinshafer | 414/607 X |
| 4,491,436 | 1/1985 | Easton | 414/722 X |
| 4,699,565 | 10/1987 | Seaberg | 414/607 X |
| 4,708,576 | 11/1987 | Conley | 414/785 X |
| 4,764,082 | 8/1988 | Quinn | 414/607 X |

FOREIGN PATENT DOCUMENTS

| | | | |
|---|---|---|---|
| 231894 | 3/1959 | Australia | 414/785 |
| 188651 | 2/1957 | Austria | 414/785 |
| 959267 | 2/1957 | Fed. Rep. of Germany | 414/785 |
| 1205449 | 11/1965 | Fed. Rep. of Germany | 414/785 |
| 1431698 | 1/1969 | Fed. Rep. of Germany | 414/723 |
| 3318388 | 11/1984 | Fed. Rep. of Germany | 414/785 |
| 3340286 | 5/1985 | Fed. Rep. of Germany . | |
| 223422 | 6/1985 | Fed. Rep. of Germany | 414/607 |
| 8513646 | 12/1985 | Fed. Rep. of Germany . | |
| 243017 | 2/1987 | Fed. Rep. of Germany | 414/785 |
| 2397364 | 3/1979 | France | 414/785 |
| 52-5145 | 1/1977 | Japan | 414/785 |
| 53-119573 | 10/1978 | Japan | 414/785 |
| 161424 | 11/1957 | Sweden | 414/723 |
| 1491473 | 11/1977 | United Kingdom | 414/607 |
| 2150112 | 6/1985 | United Kingdom . | |

*Primary Examiner*—Robert J. Spar
*Assistant Examiner*—Robert S. Katz
*Attorney, Agent, or Firm*—Bereskin & Parr

[57] ABSTRACT

An anti-rattle lower hanger is provided for mounting a lift truck fork to the lower carriage member of a lift truck. The lower hanger has a first end mountable to the shank of a lift truck fork and a raised lip spaced apart from the first end to define a channel between the lip and the shank for receiving a retaining edge of a lower carriage member of the lift truck. The lower hanger has a pair of openings extending through the lip which threadedly receive respective tightening members. The tightening members are extendable from each of the openings to engage the retaining edge of the lower carriage when the hanger is mounted over the lower carriage member.

7 Claims, 3 Drawing Sheets

FORK STABILIZING DEVICE

FIELD OF THE INVENTION

This invention relates generally to forks for material handling trucks and more particularly to devices for minimizing fork rattle.

BACKGROUND OF THE INVENTION

An annoying aspect of many conventional material handling trucks equipped with lifting forks is the tendency of the forks to rattle when the truck is travelling in an unloaded condition. It is desirable to minimize or eliminate this rattling to reduce the operational noise of the truck and also to create the impression that the truck is more solidly built.

Fork rattle generally arises from the mounting system used to mount the forks. One conventional way of mounting lift truck forks is to provide upper and lower carriage members or bars extending transversely across the mast of the lift truck and attaching the forks to these members. The upper carriage member has an upwardly extending ledge adjacent its outer face and the lower carriage member has a downwardly extending ledge adjacent its outer face. The fork is provided with upper and lower hangers having recesses for receiving the ledges of the carriage members to enable the forks to be slid over the ledges of the carriage members and laterally along the carriage members. As a pair of forks are generally used for material handling purposes, the slidability is desirable in order to enable the fork spacing to be altered to suit the various handling requirements.

In order to facilitate both the mounting of the fork and its slidability along the carriage member, the claw spacing and dimensions allow some clearance to minimize binding between the carriage members and the claws. This clearance however gives rise to rattling of the forks when there is no load on the forks to urge the forks or the retaining claws against the carriage members.

Various devices have been developed to take up the clearance between the hangers and the carriage members to stabilize the forks and thereby reduce their tendency to rattle. Examples of such devices are described in U.K. patent application 2150112A, German patents 3318388 C2, 3340286 Cl and German Design Pat. No. G8513646.8. These devices. The first type is a resilient strip which may be mechanically or adhesively securable to the carriage member or the hanger. The second type of device disclosed is a vertically movable plunger mounted to the shank of the lift truck fork and having a resilient plunger on its end that bears against the retaining ledge of the carriage bar. This latter type of device includes a biasing spring for urging the plunger toward the carriage bar.

A disadvantage with the first type of device is the amount of clearance which must be left between the hanger and the carriage member to accommodate the device. If the device were to be dislodged, as may easily happen during mounting or adjustment of the forks, an excessive clearance may be left between the hanger and the carriage member. With this excessive clearance, the fork may fail to meet some of the safety standards which set out maximum amounts of clearance for such structures. A further disadvantage to the first type of device is that it takes up the clearance between the hangers and the carriage members and thereby makes mounting and adjustment of the forks more difficult.

A disadvantage with the second type of device is its relative complexity which has an adverse effect on its manufacturing costs and the cost to install it on a fork. The second type of device also has the disadvantage that it does not have a retracted position and accordingly would interfere with mounting of the forks to the carriage members and subsequent adjustment of the forks.

It is apparent therefore that there is a need for a fork stabilizing device that is inexpensive, simple, easy to use and retractable so as not to interfere with mounting of the forks and their movement along the carriage members.

SUMMARY OF THE INVENTION

An anti-rattle lower hanger is provided for mounting a lift truck fork having a shank to a lower carriage member of a lift truck, the lower carriage member having a retaining ledge adjacent an outer face thereof. The lower hanger comprises a first end mountable to the shank and a raised lip spaced apart from the first end to define a channel, at least when the first end is mounted to the shank, for receiving the retaining ledge of the lower carriage. The lower hanger further comprises at least two openings extending through the lip for receiving respective tightening members which are extendable from each of the openings to engage the retaining ledge of the lower carriage when the hanger is mounted over the lower carriage member. The lower hanger may include tightening members which are threadedly received in the openings in the lip and are provided with tool engaging surfaces to enable axial adjustment of the tightening members to urge the lip away from the ledge.

DESCRIPTION OF THE DRAWINGS

Preferred embodiments of the invention are described below with reference to the attached drawings in which.

DESCRIPTION OF PREFERRED EMBODIMENTS

Figure 1:
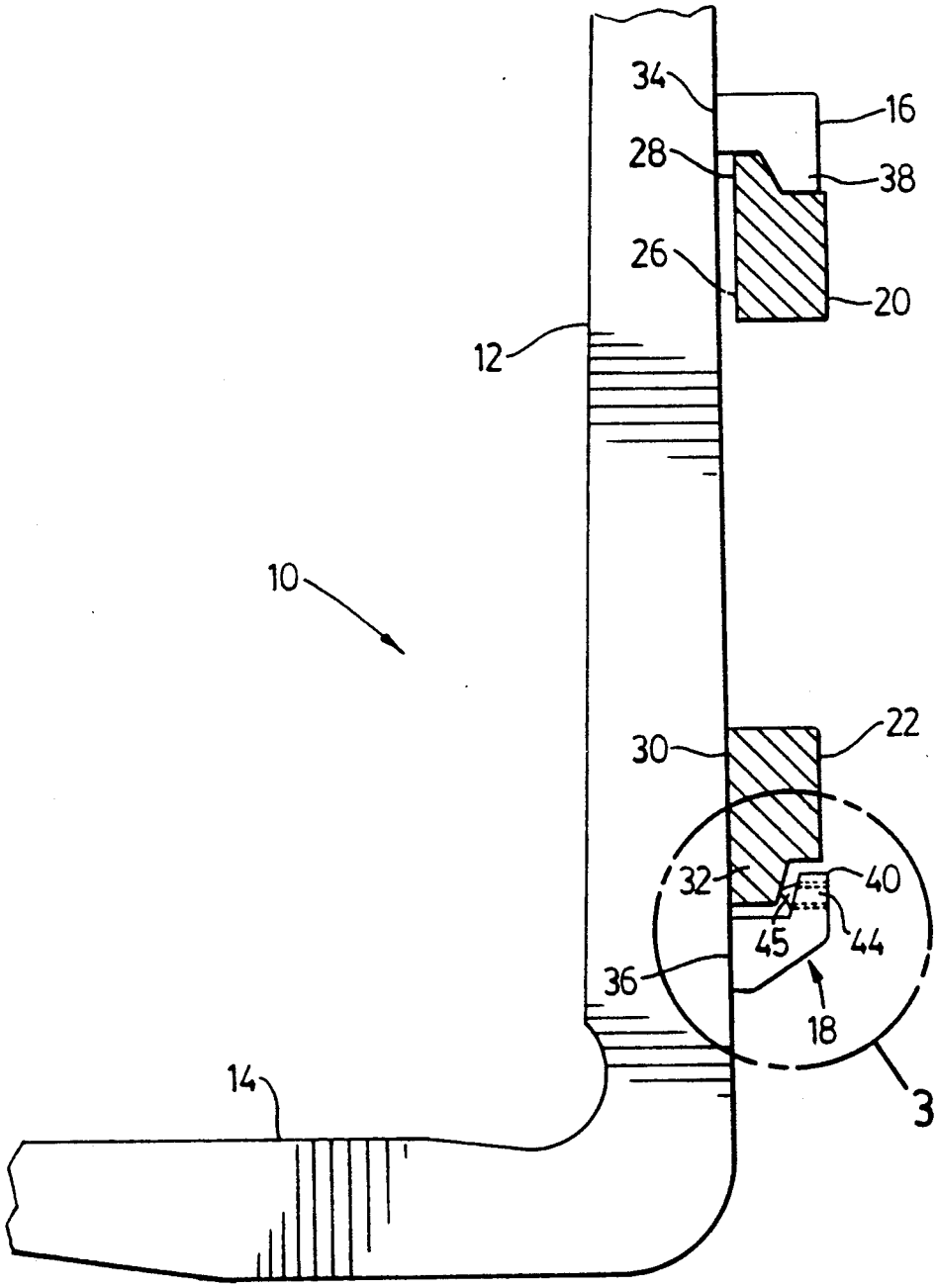
FIG. 1 is a side elevation of a portion of a lift truck fork with an anti-rattle lower hanger according to the present invention mounted thereon.

Referring to FIG. 1, a lift truck fork is generally indicated by Reference 10. The fork has a generally vertical shank 12 and a generally horizontal blade 14. Upper and lower hangers, 16 and 18 respectively, are provided on the rear of the shank 12 to mount the fork 10 to the carriage of a lift truck. The upper carriage member has an outer face 26 facing the shank 12. The upper carriage member 20 further has a retaining ledge 28 extending upwardly adjacent the face 26. Similarly, the lower carriage member 22 has an outer face 30 facing the shank 12 and a downwardly extending retaining ledge 32 adjacent the outer face 30.

The upper hanger 16 and lower hanger 18 have respective first ends 34 and 36 which attach to the shank 12. Attachment may be by suitable means such as welding or bolting. The upper hanger 16 and lower hanger 18 further have respective raised lips 38 and 40. The raised lips 38 and 40 are spaced apart from the respective first ends 34 and 36 to define channels which receive the upper and lower retaining edges, 28 and 32 respectively, of the upper and lower carriage members 20 and 22 respectively.

As can be seen from FIG. 1, the spacing between the upper and lower hangers, 16 and 18 respectively, exceeds the distance between the upper and lower carriage members, 20 and 22 respectively. This enables the upper and lower hangers, 16 and 18 respectively, to be mounted over the ends of and slid along the respective upper and lower carriage members, 20 and 22. This clearance however allows movement between the fork 10 and the upper and lower carriage members 20 and 22 which gives rise to noise or rattling when a lift truck with the forks attached is moved without load on the forks. To minimize this noise, the present invention provides a lower hanger 18 which enables this clearance to be taken up in order to minimize the rattle. The "anti-rattle" lower hanger is described in more detail below.

Figure 2:
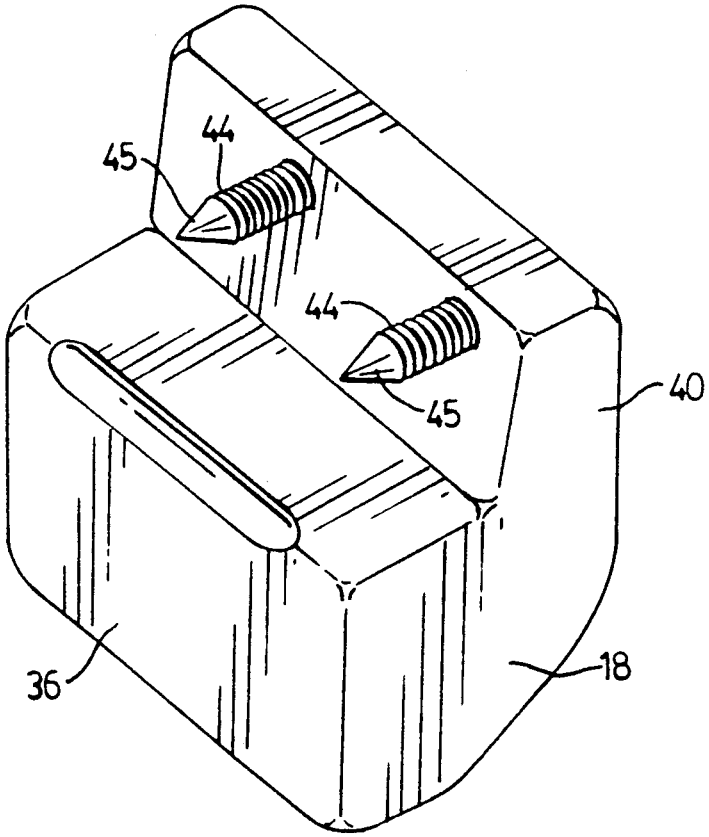
FIG. 2 is an isometric view of an anti-rattle lower hanger according to the present invention.
Figure 3:
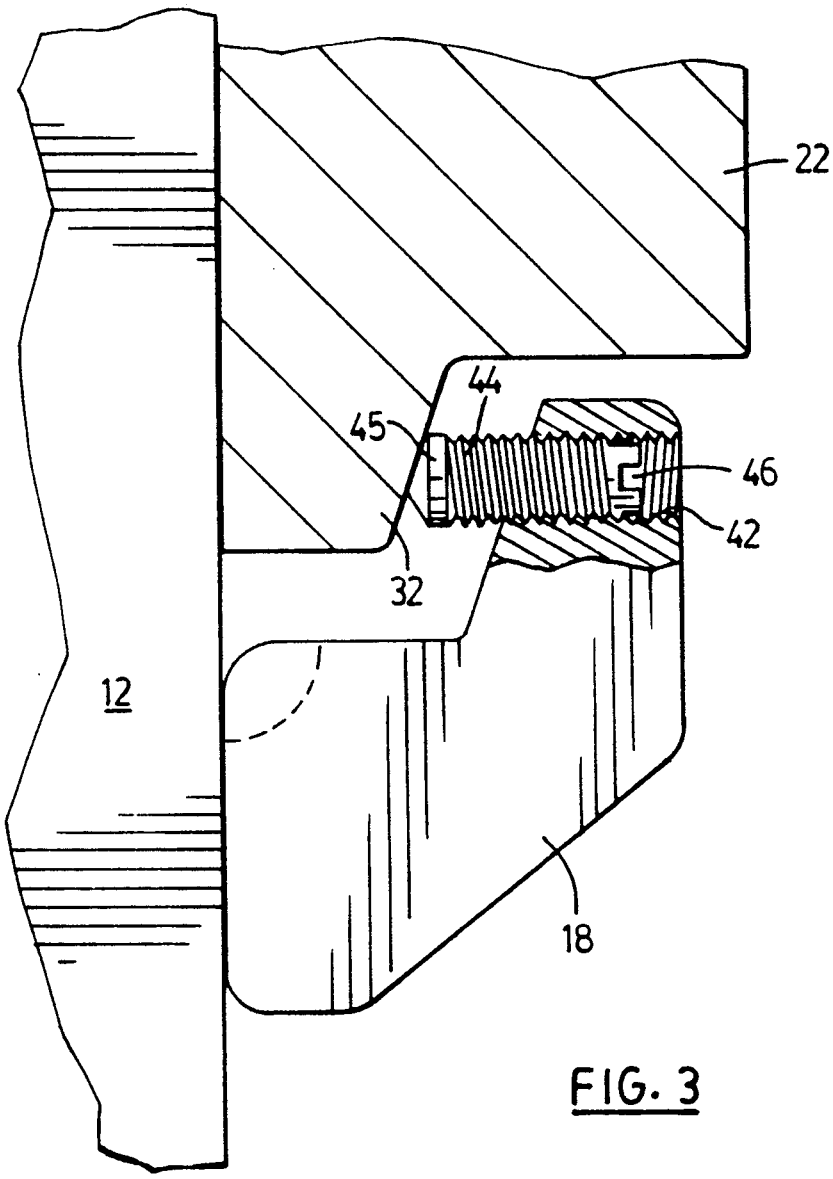
FIG. 3 is an enlargement of the encircled area of FIG. 1.

Referring to FIGS. 2 and 3, the lower hanger 18 has two generally cylindrical openings 42 extending through the lip. The openings 42 are provided with internal threads at least part way along their length. Respective externally threaded tightening members 44 are threaded into the openings 42 so that the ends 45 of the tightening members 44 extend in to the channel defined between the raised lip 40 and the shank 12. The tightening members 44 are provided with slots 46 or similar tool engaging surfaces permitting them to be threaded along the opening 42. In use, once the fork is mounted on the lift truck carriage the tightening members 44 in the lower hanger 18 are rotated using a screwdriver or other suitable tool to axially move the tightening members 44 toward the retaining ledge 32 of the lower carriage member 22. In this manner, the clearance between the lower carriage member 22 and the lower hanger 18 is taken up and the tendency of the fork 10 to rattle is reduced or eliminated.

Figure 4:
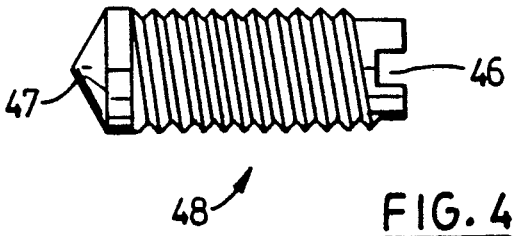
FIG. 4 is a front elevation of a tightening member according to the present invention.

In order to maximize the stabilizing effect of the anti-rattle lower hanger 18, the tightening members 44 should be mounted as far apart as possible toward the edges of the lower hanger 18. The tightening members 44 may, as shown in FIG. 4, comprise a threaded rod or bolt 48 and may have a resilient tip 47 to provide additional cushioning. An advantage to using a tightening member with a resilient tip is that it will provide some cushioning even if not cinched up tight against the carriage member.

Alternatively, the tightening members 44 may be of a polymeric material such as nylon or polyurethane which has some resiliency. Suitable results have been obtained using a polymeric tightening member 44 having a thread with a pitch or diameter which is slightly larger than would be suitable for a metallic rod or bolts. In this manner, the combination of the slightly oversized thread with the resiliency of the tightening member 44 permits the tightening member 44 to be threaded axially along the openings 42 while providing enough friction to prevent the tightening members 44 from working loose.

It is intended that the foregoing description be interpreted in an illustrative rather than a restrictive sense. Accordingly, variations to the structure described may be apparent to persons skilled in the art of lift truck forks in adapting the present invention to specific applications. It is intended that this specification extend to cover any such variations insofar as they are within the spirit and scope of the following claims.

I claim:

1. An anti-rattle lower hanger for mounting a lift truck fork to a elevatable lift truck carriage, said carriage having upper and lower mounting bars, said fork having a blade and a shank, said lower mounting bar having a retaining ledge adjacent an outer face thereof, said lower hanger comprising a first end for mounting said lower hanger to said shank of said fork, a generally vertically raised lip horizontally spaced from said first end, said raised lip defining a generally vertical channel between said raised lip and said shank when said hanger is mounted to said shank, said channel adapted to receive said retaining ledge of said lower mounting bar;

at least one generally horizontally oriented internally threaded opening extending through said lip for threadedly receiving a tightening member which tightening member is extendable from said opening to into said channel to engage the retaining ledge of the lower mounting bar when said fork is mounted on said lift truck carriage, and a tightening member which is threadedly received in said opening in said lip and is provided with a tool engaging surface to enable axial adjustment of said tightening member to urge said ledge away from said lip.

2. An anti-rattle lower hanger as claimed in claim 1 further comprising at least two of said internally threaded openings and at least two of said tightening members.

3. An anti-rattle lower hanger as claimed in claim 2 wherein said tightening members are made of a resilient polymeric material and have an external thread in which at least one of the pitch and the diameter is slightly larger than the corresponding dimension of the thread in said openings to cause frictional binding between said tightening members and said openings.

4. An anti-rattle lower hanger as claimed in claim 3 wherein the material of said tightening members is selected from the group comprising nylon and polyurethane.

5. An anti-rattle lower hanger as claimed in claim 2 wherein said tightening members have a resilient tip attached to a threaded metallic portion.

6. A fork for use on an elevatable fork lift truck, said fork comprising a blade and a shank, the shank of said fork having upper and lower hangers for mounting said lift truck fork to a lift truck carriage, said lower hanger having a first end for mounting said lower hanger to said shank of said fork, a generally vertically raised lip horizontally spaced from said first end, said raised lip defining a generally vertical channel between said raised lip and said shank of said fork, said channel adapted to receive a retaining ledge of a lower mounting bar of said lift truck carriage; at least one generally horizontally oriented internally threaded opening extending through said lip for threadedly receiving a tightening member which tightening member is extendible from said opening into said channel to engage said retaining ledge of the lower mounting bar when said fork is mounted on said lift truck carriage, and a tightening member which is threadedly received in said opening in said lip and is provided with a tool engaging surface to enable axial adjustment of said tightening member to urge said ledge away from said lip.

7. A fork as claimed in claim 7 further comprising at least two of said internally threaded openings and at least two of said tightening members.

* * * * *